US010557484B2

(12) United States Patent
Kuromusha

(10) Patent No.: US 10,557,484 B2
(45) Date of Patent: Feb. 11, 2020

(54) FLUID CONTROL DEVICE

(71) Applicant: Shimadzu Corporation, Kyoto (JP)

(72) Inventor: Junya Kuromusha, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 114 days.

(21) Appl. No.: 15/741,868

(22) PCT Filed: Jul. 6, 2015

(86) PCT No.: PCT/JP2015/069437
§ 371 (c)(1),
(2) Date: Jan. 4, 2018

(87) PCT Pub. No.: WO2017/006417
PCT Pub. Date: Jan. 12, 2017

(65) Prior Publication Data

US 2018/0202472 A1 Jul. 19, 2018

(51) Int. Cl.
*F15B 13/08* (2006.01)
*F15B 11/16* (2006.01)
(Continued)

(52) U.S. Cl.
CPC ..... *F15B 13/0807* (2013.01); *F15B 11/16* (2013.01); *F15B 13/024* (2013.01); *F15B 13/027* (2013.01); *F15B 13/06* (2013.01); *F15B 13/0832* (2013.01); *F15B 13/0871* (2013.01); *B66F 9/22* (2013.01); *F15B 2211/30505* (2013.01); *F15B 2211/50518* (2013.01);
(Continued)

(58) Field of Classification Search
CPC ..... F15B 2211/5156; B66F 9/22
See application file for complete search history.

(56) References Cited

U.S. PATENT DOCUMENTS 4,215,622 A * 8/1980 Chichester ..... B66F 9/22 414/621
4,561,463 A 12/1985 Brownbill et al.
(Continued)

FOREIGN PATENT DOCUMENTS

CN 103899588 A 7/2014
JP S62-258204 A 11/1987
(Continued)

OTHER PUBLICATIONS

International Search Report dated Oct. 6, 2015 of corresponding International application No. PCT/JP2015/069437; 3 pgs.
(Continued)

*Primary Examiner* — Jessica Cahill
*Assistant Examiner* — Richard K. Durden
(74) *Attorney, Agent, or Firm* — Maier & Maier, PLLC

(57) ABSTRACT

A fluid control device provided with a plurality of switching valves and a plurality of relief valves. A sub-relief passage communicating with a tank when the switching valves are in any state other than neutral is branched from a parallel passage for guiding a high-pressure hydraulic fluid to the switching valves. A sub-relief valve is provided within the sub-relief passage, and a check valve that minimizes the flow of hydraulic fluid toward a hydraulic pressure supply source is provided between switching valves and the point of branching of the sub-relief passage in the parallel passage.

1 Claim, 4 Drawing Sheets

(51) Int. Cl.
*F15B 13/02* (2006.01)
*F15B 13/06* (2006.01)
*B66F 9/22* (2006.01)

(52) U.S. Cl.
CPC ..... *F15B 2211/5151* (2013.01); *F15B 2211/5156* (2013.01); *F15B 2211/55* (2013.01); *F15B 2211/7135* (2013.01)

(56) References Cited

U.S. PATENT DOCUMENTS 4,745,844 A * 5/1988 Larsen ..... B66F 9/22 60/484
5,277,027 A * 1/1994 Aoyagi ..... E02F 9/2232 60/420
5,970,709 A * 10/1999 Tohji ..... E02F 9/2242 60/421
6,314,997 B1 * 11/2001 Yamashita ..... B66F 9/22 137/596.13
6,976,358 B2 * 12/2005 Kim ..... E02F 9/2221 60/450
7,222,484 B1 5/2007 Dornbach
8,215,107 B2 * 7/2012 Pfaff ..... F15B 11/055 60/424
2003/0115864 A1 6/2003 Mickelson
2009/0025380 A1 * 1/2009 Harsia ..... F15B 11/163 60/420
2013/0160443 A1 * 6/2013 Ballweg ..... F15B 11/162 60/468

FOREIGN PATENT DOCUMENTS

JP H11-315803 A 11/1999
JP 2007-155109 A 6/2007
JP 2007-239992 A 9/2007

OTHER PUBLICATIONS

The extended European search report dated Feb. 21, 2019, in corresponding European patent application No. 15897680.3; 6 pgs.
Office Action dated May 27, 2019, in corresponding Chinese Application No. 201580081465.7; 10 pages.

* cited by examiner

FLUID CONTROL DEVICE

FIELD

The present invention relates to a fluid control device that is used in industrial vehicles or industrial machines and is equipped with a plurality of switching valves and a plurality of relief valves.

BACKGROUND

From related art, in industrial vehicles and the like, a fluid control device equipped with a plurality of switching valves has been known. This device is used by connecting an actuator to each switching valve, respectively. As an actuator connected to the switching valve of such a fluid control device, for example, a lift cylinder for raising and lowering a loading platform in a forklift or a tilt cylinder for inclining a mast supporting the loading platform forward and backward is adopted.

Incidentally, in such a fluid control device, in some cases, hydraulic fluid pressures necessary for operating each actuator may be different from each other. In other words, the hydraulic fluid pressure necessary for raising the loading platform, the hydraulic fluid pressure necessary for inclining the mast forward or backward, and the hydraulic fluid pressure necessary for an actuator for an attachment such as a clamping function which is a case of being added separately are different from each other. From this, it is conceivable to provide a plurality of relief valves, such as providing the relief valves at each cylinder port. Specifically, it is conceivable to provide a main-relief valve for preventing the hydraulic fluid pressure in a passage for supplying the hydraulic fluid from a fluid pressure supply source to each actuator from exceeding a predetermined first fluid pressure which is a highest fluid pressure, and it is conceivable to provide a sub-relief valve for preventing the hydraulic fluid pressure supplied to an actuator for other tilt or attachment from exceeding a second fluid pressure lower than the first fluid pressure, with respect to an actuator such as a lift cylinder requiring the highest hydraulic fluid pressure. When such a configuration is adopted, an actuator which does not require a high hydraulic fluid pressure and a pipe associated with the actuator are protected. In addition, by adopting the actuator and the pipe having relatively low pressure resistance performance, it is possible to reduce the cost. Installing examples of the sub-relief valve are as follows (see, for example, Patent Documents 1 and 2).

In Patent Document 1, when the switching valve connected to the lift cylinder, which is an actuator requiring the highest hydraulic fluid pressure, takes a position other than a raised position to direct the hydraulic fluid to the lift cylinder, the hydraulic fluid from the hydraulic pressure supply source is directed to the sub-relief valve. However, when this configuration is adopted, the following problems may occur. That is, when another actuator is operated in a state in which the lift cylinder is located at the raised position, since the hydraulic fluid is not directed to the sub-relief valve, the hydraulic fluid at a higher pressure than the second fluid pressure may be directed to the another actuator. At this time, another actuator or the pipe associated with the actuator may be broken unless devices capable of withstanding the highest pressure are selected. On the other hand, when another actuator or the pipe is made to withstand the high pressure, although it is possible to prevent breakage, another problem arises in which it is not possible to achieve the cost reduction as described in the preceding paragraph.

In Patent Document 2, when a switching valve connected to a member other than the lift cylinder takes a position for operating the actuator, that is, a position other than a neutral position, the hydraulic fluid from the hydraulic pressure supply source is directed to a sub-relief passage including a sub-relief valve, other than the actuator. The sub-relief passage branches inside the switching valve. When such a configuration is adopted, even in a case where the lift cylinder is located at the raised position, the sub-relief valve operates when the hydraulic fluid pressure directed to another actuator exceeds the second fluid pressure. Thus, the problem described in the previous paragraph is solved. However, when adopting such a configuration, in order to prevent the occurrence of problems due to the fact that the actuators communicate with each other inside the switching valve and via the sub-relief passage in a case where the plurality of switching valves simultaneously take the positions other than the neutral position, it is necessary to separately provide a check valve in the sub-relief passage. Therefore, there is another problem of increases in the number of components and assembling man-hours.

PATENT DOCUMENT

Patent Document 1: U.S. Pat. No. 4,561,463
Patent Document 2: JP-A-2007-239992

SUMMARY

The present invention has been made under such a circumstance, and an object thereof is to prevent a high-pressure hydraulic fluid from being directed to an actuator which does not require a high hydraulic fluid pressure and has relatively low pressure resistance performance, without causing an increase in the number of components and assembling man-hours.

In order to solve the above problems, a fluid control device according to the present invention has the following configuration. That is, the fluid control device according to the present invention includes a plurality of switching valves; a high-pressure flow path which receives supply of high-pressure hydraulic fluid from a hydraulic pressure supply source, and passes through the plurality of switching valves in a neutral state; a parallel flow path which branches from the high-pressure flow path to direct the hydraulic fluid to each of the switching valves; a return flow path which receives and directs the hydraulic fluid having passed through all the switching valves via the high-pressure flow path and the hydraulic fluid discharged from each switching valve to a tank; a main-relief passage through which a part between the hydraulic pressure supply source and the switching valve located on a most upstream side communicates with the return flow path; a main-relief valve which is provided in the main-relief passage and opens when the fluid pressure of the high-pressure flow path exceeds a predetermined first fluid pressure; a sub-relief passage which branches from the parallel passage, reaches the switching valve, and communicates with the tank when the switching valve is in a predetermined state other than the neutral state; a sub-relief valve which is provided in the sub-relief passage, and opens when the fluid pressure of the parallel flow path exceeds a second fluid pressure lower than the first fluid pressure; and a check valve which suppresses the flow of hydraulic fluid toward a hydraulic pressure supply source provided between the branch with the sub-relief passage and the switching valve in the parallel passage.

In such a case, since the sub-relief passage branches off from the parallel passage, the sub-relief passage and the passage reaching the actuator from the switching valve do not communicate with each other inside the switching valve. Further, even when a plurality of actuators is operated at the same time, it is possible to prevent the hydraulic fluid in a certain actuator from flowing out to another actuator via the parallel passage and the sub-relief passage, by the check valve in the parallel flow path. Accordingly, there is no need to separately provide a check valve in the sub-relief passage, and the number of components can be reduced.

According to the present invention, it is possible to prevent a high-pressure hydraulic fluid from being directed to an actuator which does not require a high hydraulic fluid pressure and has relatively low pressure resistance performance, without causing an increase in the number of components and assembling man-hours.

DETAILED DESCRIPTION OF THE DRAWINGS

Figure 1:
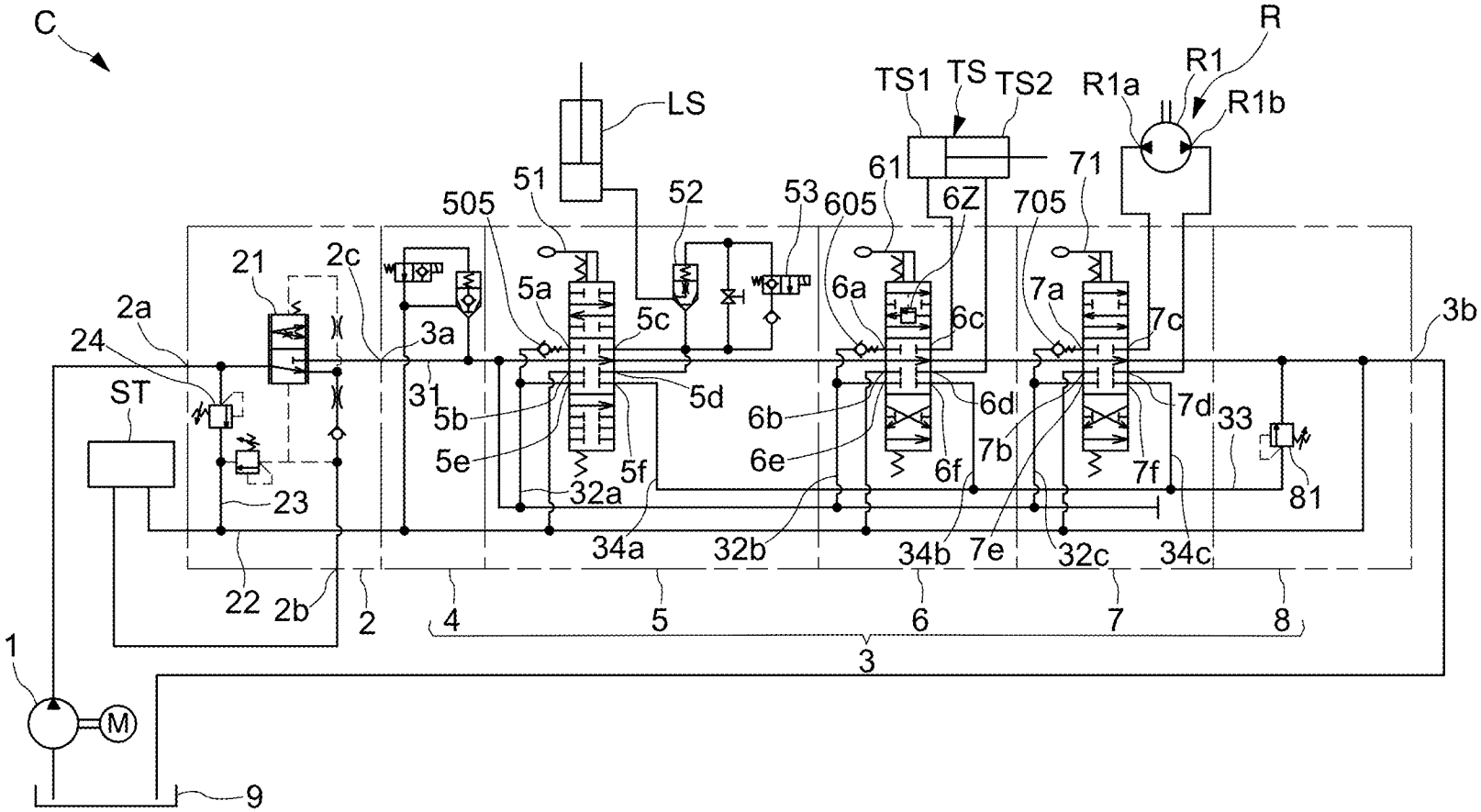
FIG. 1 is a diagram illustrating a fluid control device according to an embodiment of the present invention.

An embodiment of the present invention will be described below with reference to FIGS. 1 to 4.

A fluid control device C according to the present embodiment includes a tank 9 for storing a hydraulic fluid, a hydraulic pump 1 which sends the hydraulic fluid from the tank 9, a priority valve mechanism 2 which receives the supply of the hydraulic fluid from the hydraulic pump 1, and a fluid pressure unit 3 which is stacked on the priority valve mechanism 2. The fluid pressure unit 3 has a pump side port 3*a* which receives the supply of hydraulic fluid from a surplus flow output port 2*c* of the priority valve mechanism 2, and a tank side port 3*b* which discharges the hydraulic fluid.

The priority valve mechanism 2 is used for a forklift or the like, and has the same configuration as a mechanism which is known as this type of priority valve mechanism which supplies the hydraulic fluid to a steering mechanism, and a fluid pressure unit formed by stacking a plurality of switching valves. That is, various valves such as the priority valve main body 21 are integrally incorporated in the interior, a priority diversion function of dividing the supplied hydraulic fluid into a priority flow and a surplus flow. The priority valve mechanism 2 includes an introduction port 2*a*, a discharge port 2*b*, and a surplus flow output port 2*c*. The introduction port 2*a* is an introduction port of the high-pressure hydraulic fluid discharged from the hydraulic pump 1. The discharge port 2*b* communicates with a steering operation assisting circuit ST, and preferentially discharges the hydraulic fluid necessary when performing the steering operation. The surplus flow output port 2*c* discharges the surplus hydraulic fluid. Further, the priority valve mechanism 2 includes a return flow path 22, a main-relief passage 23, and a main-relief valve 24. The hydraulic fluid discharged from the steering operation assisting circuit ST passes through the return flow path 22. The main-relief passage 23 short-circuits the introduction port 2*a* and the return flow path 22. The main-relief valve 24 is provided in the main-relief passage 23 to prevent the pressure of the hydraulic fluid introduced into the introduction port 2*a* from exceeding a predetermined first fluid pressure.

The fluid pressure unit 3 includes a combination of an unloading valve 4, first, second, and third fluid control valves 5, 6, and 7, and a sub-relief valve section 8 equipped with a sub-relief valve 81. Further, the fluid pressure unit 3 further has a high-pressure flow path 31, first to third parallel flow paths 32*a* to 32*c*, a return flow path 33, and first to third sub-relief passages 34*a* to 34*c* therein. The high-pressure flow path 31 receives the hydraulic fluid supplied from the pump side port 3*a*. The first to third parallel flow paths 32*a* to 32*c* branch from the high-pressure flow path 31 to supply the hydraulic fluid to the first to third fluid control valves 5 to 7. The return flow path 33 is in communication with the return flow path 22 of the priority valve mechanism 2 and receives the hydraulic fluid having passed through the third fluid control valve 7 via the high-pressure flow path 31 and the hydraulic fluid discharged from the first to third fluid control valves 5 to 7. The first to third sub-relief passages 34*a* to 34*c* are connected to the return flow path 33 from the first to third parallel flow paths 32*a* to 32*c* via the first to third fluid control valves 5 to 7. Each of the first to third fluid control valves 5 to 7 functions as the switching valve of the present invention.

The first parallel flow path 32*a* branches from the high-pressure flow path 31 and is connected to the first fluid control valve 5. Further, a check valve 505 which suppresses the flow of the hydraulic fluid from the first fluid control valve 5 toward the pump is provided in the first parallel flow path 32*a*.

The second parallel flow path 32*b* branches from the first parallel flow path 32*a* and is connected to the second fluid control valve 6. Further, a check valve 605 which suppresses the flow of the hydraulic fluid from the second fluid control valve 6 toward the pump is provided in the second parallel flow path 32*b*.

Further, the third parallel flow path 32*c* branches from the second parallel flow path 32*b*, and is connected to the third fluid control valve 7. Further, a check valve 705 which suppresses the flow of the hydraulic fluid from the third fluid control valve 7 toward the pump is provided in the third parallel flow path 32*c*.

The first sub-relief passage 34*a* branches from the upstream side of the check valve 505 in the first parallel passage 32*a*, and joins the return flow path 33 via the first fluid control valve 5 and the sub-relief valve 81. However, an upstream side and a downstream side of the first fluid control valve 5 in the first sub-relief passage 34*a* are always closed by the first fluid control valve 5.

The second sub-relief passage 34*b* branches from the upstream side of the check valve 605 in the second parallel passage 32*b*, joins the first sub-relief passage 34*a* via the second fluid control valve 6, and joins the return flow path 33 via the sub-relief valve 81.

The second sub-relief passage 34*c* branches from the upstream side of the check valve 1705 in the third parallel passage 32*c*, joins the second sub-relief passage 34*b* via the third fluid control valve 7, and joins the return flow path 33 via the sub-relief valve 81.

The sub-relief valve 81 opens when the hydraulic fluid pressure supplied from the parallel flow path 32*b* and 32*c* to the second and third fluid control valves 6 and 7 exceeds the second fluid pressure. The second fluid pressure is lower than the first fluid pressure which is the fluid pressure of the threshold value at which the main-relief valve 24 opens.

The unloading valve 4 is connected to, for example, a seating sensor (not illustrated), and only when the seating sensor does not detect that an operator is seated on the driver's seat, the high-pressure flow path 31 is made to communicate with the return flow path 33.

The first fluid control valve 5 has an inflow port 5*a* connected to the parallel flow path 32*a*, a discharge port 5*b* connected to the return flow path 33, and first and second output ports 5*c* and 5*d* connected to a lift cylinder LS serving as an actuator. Further, the first fluid control valve 5 can selectively take three positions of a neutral position, a rising position, and a lowered position. The neutral position causes the high-pressure flow path 31 to communicate with the return flow path 33. The rising position causes the inflow port 5*a* and the first output port 5*c* to communicate with each other. The lowered position causes the discharge port 5*b* and the second output port 5*d* to communicate with each other and causes the high-pressure flow path 31 to communicate with the return flow path 33. The first fluid control valve 5 is connected to a first operation lever 51 to receive an operation on the first operation lever 51 and perform switching among the three positions. Further, a logic valve 52 is provided between the first output port 5*c* and the lift cylinder LS. An electromagnetic valve 53 is provided in a back pressure chamber of the logic valve 52, and the lift cylinder LS is prevented from descending due to the backward flow of the hydraulic fluid from the lift cylinder LS, by the operation of the electromagnetic valve 53. As described above, the lift cylinder LS is connected to the first fluid control valve 5 via the first and second output ports 5*c* and 5*d*, and receives the supply of the hydraulic fluid to raise a fork (not illustrated) connected to the lift cylinder LS. Further, the lift cylinder LS discharges the hydraulic fluid to lower the fork (not illustrated) connected to the lift cylinder LS. Further, the first fluid control valve 5 has a pilot port 5*e* connected to the upstream side of the first sub-relief passage 34*a*, and a relief port 5*f* connected to the downstream side of the first sub-relief passage 34*a*. However, the pilot port 5*e* and the relief port 5*f* are always disconnected from each other.

The second fluid control valve 6 has an inflow port 6*a* connected to the parallel flow path 32*b*, a discharge port 6*b* connected to the return flow path 33, a first output port 6*c* connected to a cylinder chamber TS1 side of a tilt cylinder TS which is an actuator, a second output port 6*d* connected to a piston TS2 side of the tilt cylinder TS, a pilot port 6*e* connected to the upstream side of the second sub-relief passage 34*b*, and a relief port 6*f* connected to the downstream side of the second sub-relief passage 34*b*. Further, the second fluid control valve 6 can selectively take a neutral position, an inclined position, and an upright position. The neutral position causes the high-pressure flow path 31 to communicate with the return flow path 33. The inclined position causes the inflow port 6*a* and the first output port 6*c* to communicate with each other, and causes the discharge port 6*b* and the second output port 6*d* to communicate with each other. The upright position causes the inflow port 6*a* and the second output port 6*d* to communicate with each other, and causes the discharge port 6*b* and the first output port 6*c* to communicate with each other. Here, at the neutral position, the pilot port 6*e* and the relief port 6*f* are disconnected from each other. On the other hand, at the inclined position and the upright position, the pilot port 6*e* communicates with the relief port 6*f*, and a part of the high-pressure hydraulic fluid from the second parallel flow path 32*b* is directed to the second sub-relief passage 34*b*. The second fluid control valve 6 is connected to a second operation lever 61, and receives an operation on the second operation lever 61 to perform switching among the aforementioned three positions. Further, in order to prevent the mast from being inclined forward due to the backward flow of the hydraulic fluid when the mast (not illustrated) supporting the fork is stopped in the forward inclined posture, the second fluid control valve 6 is provided with a tilt lock valve 6Z. The tilt cylinder TS includes a cylinder chamber TS1 and a piston TS2. As described above, the cylinder chamber TS1 communicates with the first output port 6*c* of the second fluid control valve, and the piston TS2 side communicates with the second output port 6*d* of the second fluid control valve. Further, the supply of hydraulic fluid is received by the cylinder chamber TS1 side, and the mast (not illustrated) which is connected to the tilt cylinder TS and supports the fork (not illustrated) is inclined forward. On the other hand, when the supply of hydraulic fluid is received by the piston TS2 side, the mast (not illustrated) is returned from the forward inclined state to the upright state.

The third fluid control valve 7 has an inflow port 7*a* connected to the parallel flow path 32*c*, a discharge port 7*b* connected to the return flow path 33, a first output port 7*c* connected to a first fluid introduction port R1*a* of a rotary mechanism R which is an actuator, a second output port 7*d* connected to a second fluid introduction port R1*b* of the rotary mechanism R, a pilot port 7*e* connected to the upstream side of the third sub-relief passage 34*c* provided to branch from the parallel flow path 32*c*, and a relief port 7*f* connected to the downstream side of the third sub-relief passage 34*c*. Further, the third fluid control valve 7 can selectively take three positions of a neutral position, a positive rotation position, and a reverse rotation position. The neutral position causes the high-pressure flow path 31 to communicate with the return flow path 33. The positive rotation position causes the inflow port 7*a* and the first output port 7*c* to communicate with each other, and causes the discharge port 7*b* and the second output port 7*d* to communicate with each other. The reverse rotation position causes the inflow port 7*a* and the second output port 7*d* to communicate with each other, and causes the discharge port 7*b* and the first output port 7*c* to communicate with each other. Here, at the neutral position, the pilot port 7*e* and the relief port 7*f* are disconnected from each other. On the other hand, at the positive rotation position and the reverse rotation position, the pilot port 7*e* communicates with the relief port 7*f*, and a part of the high-pressure hydraulic fluid from the third parallel flow path 32*c* is directed to the third sub-relief passage 34*c*. Further, the third fluid control valve 7 is connected to a third operation lever 71, and receives an operation on the third operation lever 71 to perform the switching among the three positions. The rotary mechanism R is configured by utilizing a hydraulic motor R1 having first and second fluid introduction ports R1*a* and R1*b*, and drives a rotary attachment (not illustrated) such as a rotary fork connected to the hydraulic motor R1 via an output shaft. Specifically, the rotary mechanism R has a configuration which receives the supply of the hydraulic fluid from the first fluid introduction port R1*a*, rotates the rotation attachment in the positive direction to discharge the hydraulic fluid from the second fluid introduction port R1*b*, receives the supply of hydraulic fluid from the second fluid introduction port R1*b*, and rotates the rotary attachment in the positive direction to discharge the hydraulic fluid from the first fluid introduction port R1*a*. That is, a rotary attachment such as a rotary fork driven by the rotary mechanism R can rotate in both positive and reverse directions.

Both the second and third fluid control valves 6 and 7 have the following configuration. Here, since the second fluid control valve 6 and the third fluid control valve 7 have the same configuration, the configuration of the second fluid control valve 6 will be described as a representative.

Figure 2:
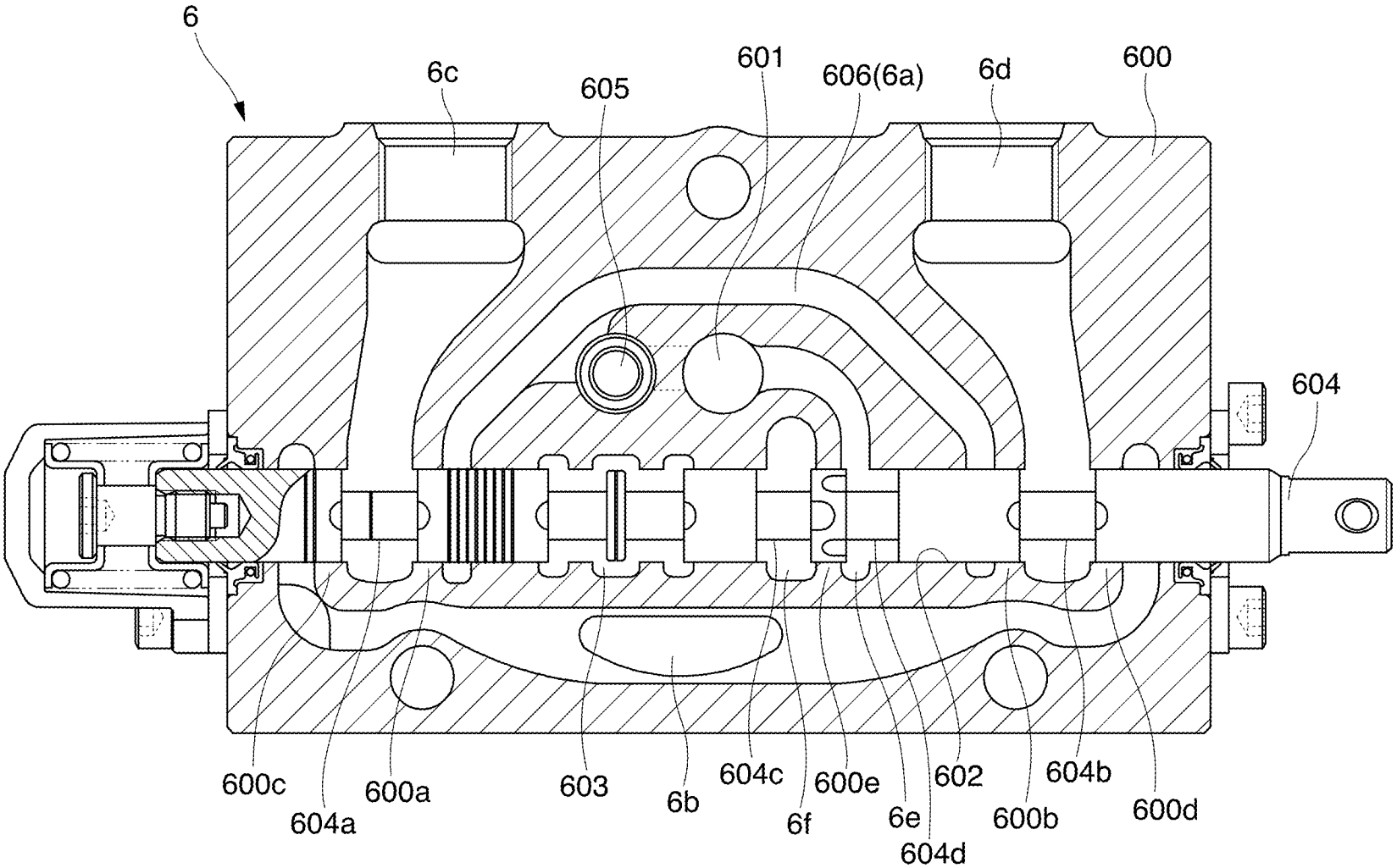
FIG. 2 is a diagram schematically illustrating a switching valve according to the same embodiment.

As illustrated in FIG. 2, the second fluid control valve 6 includes a body 600, and a spool valve body 604 capable of sliding in a spool hole 602 provided in the body 600. In the body 600, a hydraulic fluid supply path 601 constituting the second parallel flow path 32*b*, a center passage 603 constituting a high-pressure flow path 31, the check valve 605 provided in the hydraulic fluid supply path 601, the first output port 6*c*, the second output port 6*d*, the discharge port 6*b*, the pilot port 6*e*, and the relief port 6*f* are formed. Further, the downstream side of the check valve 605 in the hydraulic fluid supply path 601 is formed as an arch section 606 having a function as the inflow port 6*a*.

The spool valve body 604 is provided with a first communication groove 604*a*, a second communication groove 604*b*, a third communication groove 604*c*, and a fourth communication groove 604*d*. The first communication groove 604*a* causes the arch section 606 and the first output port 6*c* to communicate with each other at the inclined position, and causes the arch section 606 and the discharge port 6*b* to communicate with each other at the upright position. The second communication groove 604*b* causes the arch section 606 and the discharge port 6*b* to communicate with each other at the inclined position, and causes the arch section 606 and the second output port 6*d* to communicate with each other at the upright position. The third communication groove 604*c* causes the pilot port 6*e* and the relief port 6*f* to communicate with each other at the inclined position. The fourth communication groove 604*d* causes the pilot port 6*e* and the relief port 6*f* to communicate with each other at the upright position.

On the other hand, in the body 600, a first land 600*a* is provided between the arch section 606 and the first output port 6*c*, a second land 600*b* is provided between the arch section 606 and the second output port 6*d*, a third land 600*c* is provided between the first output port 6*c* and the discharge port 6*b*, a fourth land 600*d* is provided between the second output port 6*d* and the discharge port 6*b*, and a fifth land 600*e* is provided between the pilot port 6*e* and the relief port 6*f*. These first to fifth lands 600*a* to 600*e* have a function of blocking the ports via parts other than the communication grooves 604*a* to 604*d* of the spool valve body 604.

Further, although it is not illustrated, members such as a pilot spool constituting a tilt lock valve 6Z, and a spring for urging the pilot spool toward the valve closing position are disposed inside the spool valve body 604. Since the configuration and operation of the tilt lock valve 6Z have the same configuration as that well known as a tilt lock valve used for this type of fluid control valve, a detailed description thereof will not be provided.

Here, in a state in which the second fluid control valve 6 is disposed at the neutral position, as illustrated in FIG. 2, the arch section 606 and the first output port 6*c* are disconnected from each other, and the arch section 606 and the second output port 6*d* are disconnected from each other. Further, the hydraulic fluid supply path 601, the pilot port 6*e*, and the relief port 6*f* are also disconnected from one another.

Figure 3:
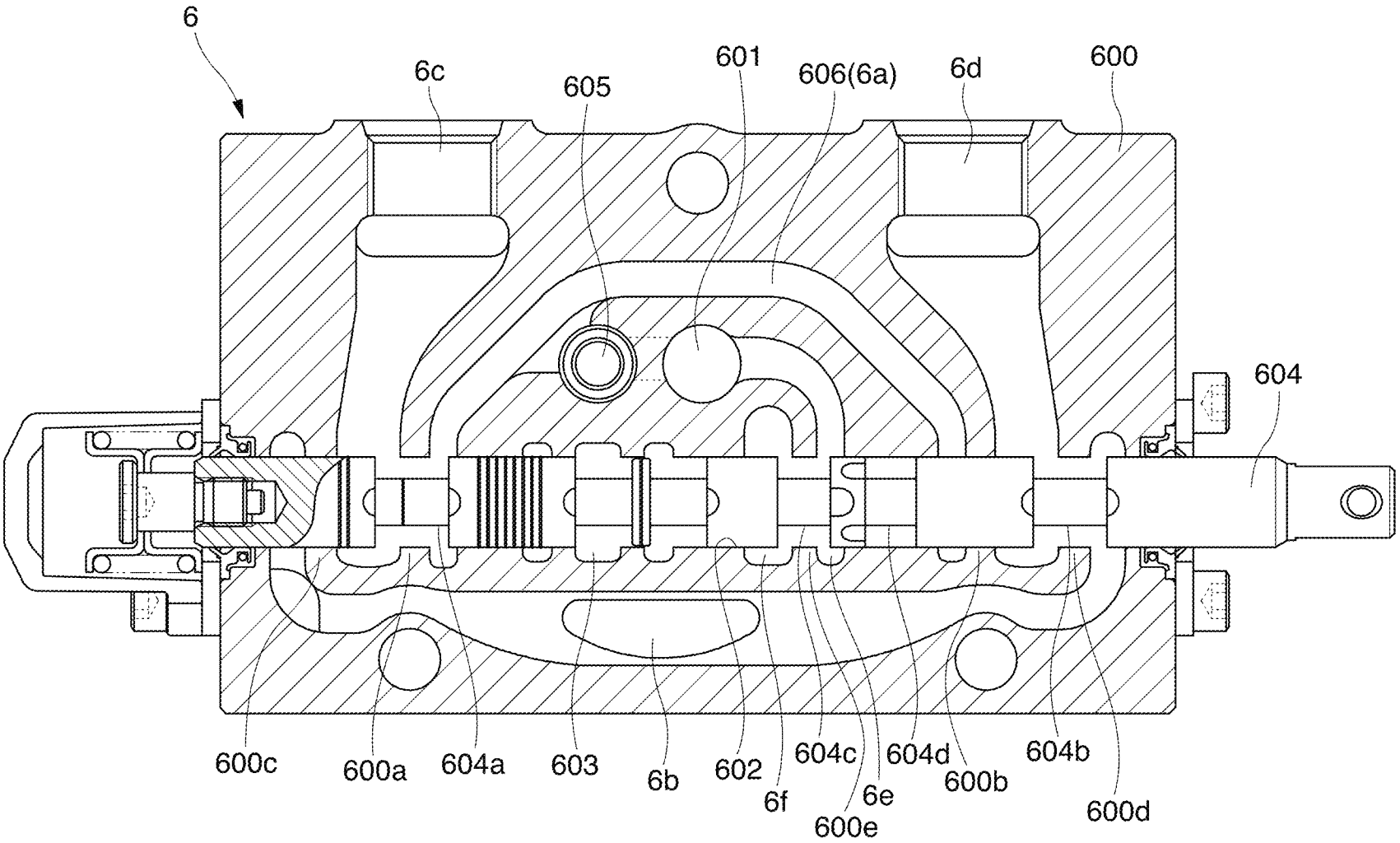
FIG. 3 is an operation explanatory view according to the same embodiment.

On the other hand, in a state in which the second fluid control valve 6 is disposed at the inclined position, as illustrated in FIG. 3, the arch section 606 and the first output port 6*c* communicate with each other, the second output port 6*d* and the discharge port 6*b* communicate with each other, respectively. Also, the hydraulic fluid supply path 601, the pilot port 6*e*, and the relief port 6*f* also communicate with one another. As a result, a part of the hydraulic fluid supplied from the pump to the second parallel flow path 32*b* is directed to the first output port 6*c*, and the other part of the hydraulic fluid is directed to the sub-relief valve 81 via the relief port 6*f*. Further, when the fluid pressure of the hydraulic fluid supplied to the second parallel flow path 32*b* exceeds the second fluid pressure, even in a case where the fluid pressure of the hydraulic fluid is lower than the first fluid pressure, the sub-relief valve 81 opens and the hydraulic fluid is directed to the tank 9 via the return passage 33.

Figure 4:
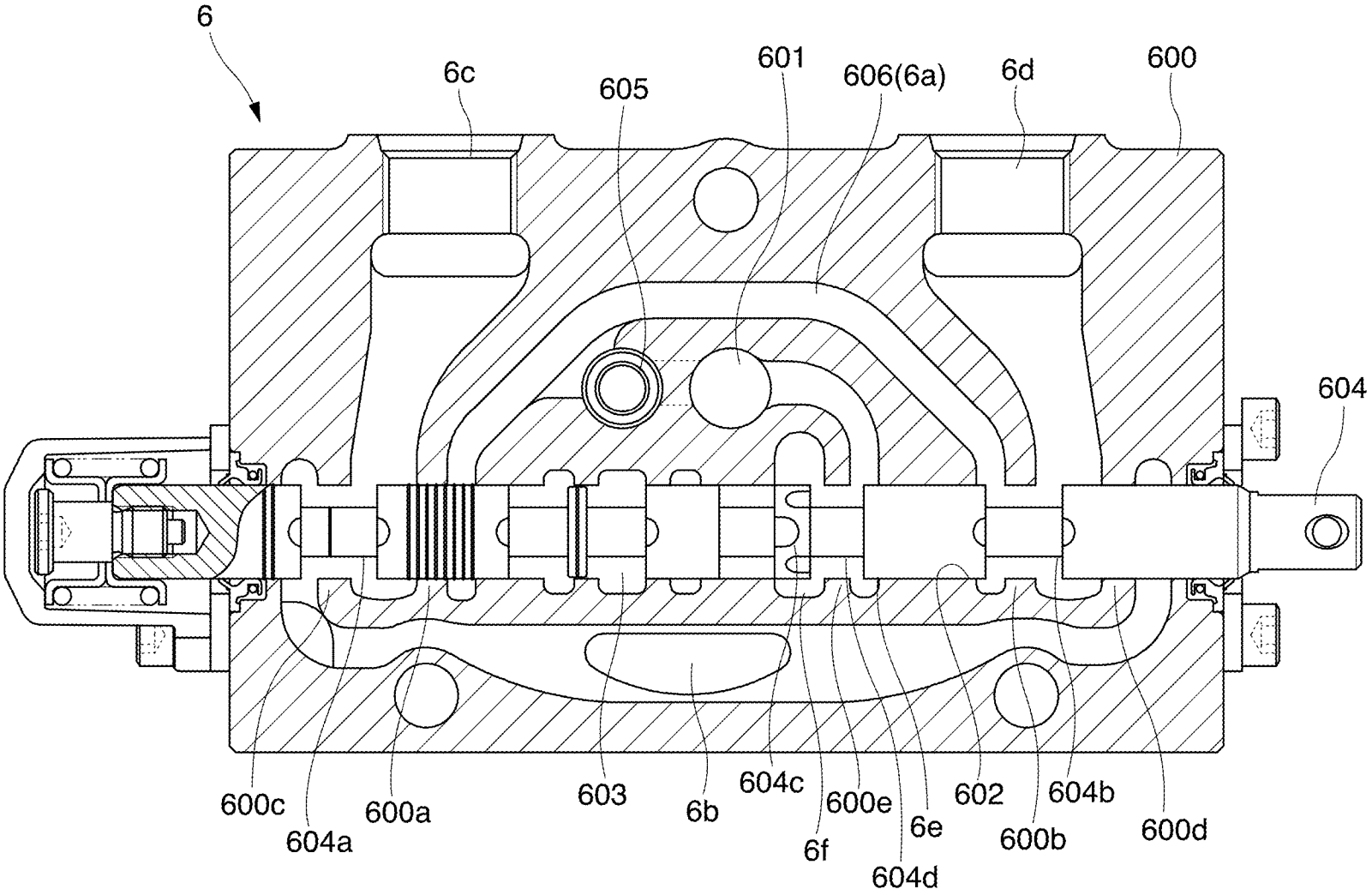
FIG. 4 is an operation explanatory view according to the same embodiment.

Further, in the state in which the second fluid control valve 6 is disposed at the upright position, as illustrated in FIG. 4, the arch section 606 and the second output port 6*d* communicate with each other, and the first output port 6*c* and the discharge port 6*b* communicate with each other, respectively. Further, similarly to the state in which the second fluid control valve 6 is disposed in the inclined position, the hydraulic fluid supply path 601, the pilot port 6*e*, and the relief port 6*f* also communicate with one another. As a result, a part of the hydraulic fluid supplied from the pump to the second parallel flow path 32*b* is directed to the first output port 6*c*, and the other part of the hydraulic fluid is directed to the sub-relief valve 81 via the relief port 6*f*. Further, when the fluid pressure of the hydraulic fluid supplied to the second parallel flow path 32*b* exceeds the second fluid pressure, even in a case where the fluid pressure of the hydraulic fluid is lower than the first fluid pressure, the sub-relief valve 81 opens, and the hydraulic fluid is directed to the tank 9 via the return passage 33.

As described above, the third fluid control valve 7 has substantially the same configuration as the second fluid control valve 6. Hereinafter, the same names as the corresponding parts in the second fluid control valve 6 and the reference numerals with the leading 6 changed to 7 are attached to each part of the third fluid control valve 7. Specifically, although it is not illustrated, the third fluid control valve 7 includes a body 700 having the same configuration as that of the body 600 of the second fluid control valve 6, and a spool valve body 704 capable of sliding inside a spool hole 702 provided in the body 700. The spool valve body 704 also has the same configuration as that of the spool valve body 604 of the second fluid control valve 6, except that a member constituting the tilt lock valve is not included therein.

On the other hand, although it is not illustrated, the first fluid control valve 5 includes a body 500 having the same configuration as that of the body 600 of the second fluid control valve 6, and a spool valve body 504 capable of sliding in a spool hole 502 provided in the body 500. The spool valve body 504 has the same configuration as that of the spool valve body 604 of the second fluid control valve 6, except that a member constituting the tilt lock valve is not included therein and the third and fourth communication grooves are not included. Further, since the spool valve body 504 does not include the third and fourth communication grooves, as described above, the pilot port 5*e* and the relief port 5*f* are always disconnected from each other.

Here, when both the second and third fluid control valves 6 and 7 are disposed at positions other than the neutral position, the second sub-relief passage 34*b* communicates with the second parallel flow path 32*b*, and the third sub-relief passage 34*c* communicates with the third parallel flow path 32*c*. However, the second sub-relief passage 34*b* branches on the upstream side of the check valve 605 in the second parallel flow path 32*b*. Further, the third sub-relief passage 34*c* branches on the upstream side of the check valve 705 in the third parallel flow path 32*c*. Therefore, the flow of the hydraulic fluid from the cylinder chamber TS1 or the piston TS2 of the tilt cylinder TS via the second and third sub-relief passages 34*b* and 34*c* to the first or second fluid introduction ports R1*a* and R1*b* of the rotary mechanism R or vice versa is suppressed by the check valves 605 and 705. In other words, it is possible to suppress such a flow of the hydraulic fluid, without providing a check valve in the second and third sub-relief passages 34*b* and 34*c*.

As described above, according to the present embodiment, the second sub-relief passage 34*b* branches from the upstream side of the check valve 605 in the second parallel passage 32*b*, and the third sub-relief passage 34*c* branches from the upstream side of the check valve 705 in the third parallel passage 32*c*. Accordingly, the sub-relief passages 34*b* and 34*c* do not communicate with the passage reaching the tilt cylinder TS or the rotary mechanism R from the switching valves 6 and 7 inside the switching valves 6 and 7. Even when the tilt cylinder TS and the rotary mechanism R simultaneously operate due to the presence of the check valves 605 and 705, the hydraulic fluid in the tilt cylinder TS does not flow out to the rotary mechanism R via the second and third sub-relief passages 34*b* and 34*c*, or vice versa, the hydraulic fluid in the rotary mechanism R does not flow out to the tilt cylinder TS via the second and third sub-relief passages 34*b* and 34*c*. Therefore, it is not necessary to additionally provide a check valve in the second and third sub-relief passages 34*b* and 34*c*, and thus, it is possible to reduce the number of components and the number of manufacturing man-hours.

The present invention is not limited to the embodiments described above.

For example, in the above-described embodiment, even when any of the second and third switching valves is located at any position other than the neutral position, the hydraulic fluid from the parallel flow path is directed to the sub-relief passage. However, depending on the type of the actuator connected to the switching valve and the type of the operation performed by the actuator, it may be necessary to direct the high-pressure hydraulic fluid. In such a case, an aspect in which the hydraulic fluid from the parallel flow path is directed to the sub-relief passage only when an operation requiring no high-pressure hydraulic fluid is performed may be adopted, and the form can also be easily selected according to the present application.

In addition, various modifications may be made within the scope that does not impair the gist of the present invention.

The invention claimed is:

1. A fluid control device comprising:

a plurality of switching valves;

a high-pressure flow path which receives a supply of high-pressure hydraulic fluid from a hydraulic pressure supply source; the high-pressure flow path configured to pass through the plurality of switching valves when said switching valves are in a neutral state;

a parallel flow path which branches from the high-pressure flow path to direct the hydraulic fluid to each of the switching valves;

a return flow path which receives and directs the hydraulic fluid having passed through all the switching valves via the high-pressure flow path and the hydraulic fluid discharged from each of the plurality of switching valves; the return flow path directing the received hydraulic fluid to a tank;

a main-relief passage through which a part between the hydraulic pressure supply source and a most upstream switching valve of the plurality of switching valves located on a most upstream side communicates with the return flow path;

a main-relief valve which is provided in the main-relief passage and opens when the fluid pressure of the high-pressure flow path exceeds a predetermined first fluid pressure;

a sub-relief passage which branches from the parallel flow path, reaches or passes through one of the plurality of switching valves, and communicates with the tank when the one switching valve, other than the most upstream switching valve of the plurality of switching valves, is in a predetermined state other than the neutral state and a sub-relief valve is open;

the sub-relief valve which is provided in the sub-relief passage, and opens when the fluid pressure of the sub-relief passage exceeds a second fluid pressure lower than the first fluid pressure; and at least one check valve for suppressing the flow of hydraulic fluid toward the hydraulic pressure supply source, wherein one of the at least one check valves is provided to each switching valve of the plurality of switching valves, the check valve being positioned in a respective parallel passage leading to each respective switching valve, between an input port of each respective switching valve and a point of the respective parallel passage where the sub-relief passage branches from the respective parallel passage.

* * * * *